US005685782A

United States Patent [19]

Lipps et al.

[11] Patent Number: 5,685,782

[45] Date of Patent: Nov. 11, 1997

[54] GOLF PRACTICE APPARATUS

[75] Inventors: John D. Lipps, Kent; Stephen J. Szczecinski, Hudson, both of Ohio

[73] Assignee: Sports Sciences, Inc., Twinsburg, Ohio

[21] Appl. No.: 206,047

[22] Filed: Mar. 4, 1994

Related U.S. Application Data

[63] Continuation-in-part of Ser. No. 941,599, Sep. 3, 1992, abandoned, which is a continuation-in-part of Ser. No. 818,199, Jan. 8, 1992, abandoned.

[51] Int. Cl.[6] ..... A63B 69/36

[52] U.S. Cl. ..... 473/209; 473/220; 473/222

[58] Field of Search ..... 273/35 R, 184 R, 273/185 R, 186.1, 186.3, 187.2, 194 R, 183.1, DIG. 17; 473/451, 207, 208, 209, 211, 219, 220, 222, 225

[56] References Cited

U.S. PATENT DOCUMENTS

| | | | |
|---|---|---|---|
| 2,080,608 | 5/1937 | Hannaford | 273/35 |
| 2,399,668 | 5/1946 | Francis | 177/353 |
| 2,571,974 | 10/1951 | Walker | 177/384 |
| 2,825,569 | 3/1958 | Alvarez | 273/186 |
| 3,020,049 | 2/1962 | McNeill | 273/186 |
| 3,070,373 | 12/1962 | Mathews et al. | 273/183 |
| 3,117,451 | 1/1964 | Ray et al. | 73/379 |
| 3,601,408 | 8/1971 | Wright | 273/186 |
| 3,677,553 | 7/1972 | Moore | 273/186 A |
| 3,892,414 | 7/1975 | Glasson et al. | 273/186.1 |
| 3,953,034 | 4/1976 | Nelson | 273/186 C |
| 4,146,230 | 3/1979 | Foster | 273/186 R |
| 4,254,956 | 3/1981 | Rusnak | 273/186 R |
| 4,304,406 | 12/1981 | Cromarty | 273/186 R |
| 4,306,722 | 12/1981 | Rusnak | 273/186 R |
| 4,437,672 | 3/1984 | Armantrout et al. | 273/185 R |
| 4,451,043 | 5/1984 | Ogawa et al. | 273/186 R |
| 4,456,257 | 6/1984 | Perkins | 273/186 R |
| 4,688,796 | 8/1987 | Wright | 273/68 |
| 4,693,479 | 9/1987 | McGwire | 273/186 A |
| 4,858,934 | 8/1989 | Ladick et al. | 273/186 A |
| 4,971,325 | 11/1990 | Lipps | 273/183 B |
| 4,971,327 | 11/1990 | Rabold | 273/186.3 |
| 4,971,328 | 11/1990 | Hernberg | 273/186 A |
| 5,000,456 | 3/1991 | Rabold | 273/186.3 |
| 5,005,835 | 4/1991 | Huffman | 273/183 B |
| 5,067,717 | 11/1991 | Harlan et al. | 273/187.2 |
| 5,161,802 | 11/1992 | Daechsel | 273/186.3 |

FOREIGN PATENT DOCUMENTS

| | | |
|---|---|---|
| 2122096 | 1/1984 | United Kingdom . |

*Primary Examiner*—Jessica Harrison
*Assistant Examiner*—James Schaaf
*Attorney, Agent, or Firm*—John L. Gray

[57] ABSTRACT

An apparatus for the practicing of golf swings utilizing a motion sensor and a radiation source on the forehead of the user which projects a radiated signal when head motion is sensed. The signal is detected by a unit contemporaneously with the golfer's swinging either-a golf club, if he is outside, or a simulated golf club provided with a beam of radiation emanating from one end thereof, if he is inside. In the case of the simulated unit which may be used indoors, details of club head registry, (open, closed, square, sweet spot, slightly toward the toe, slightly toward the heel, toe, heel, top and bottom) swing, follow through, club head speed, tempo, distance the ball travels and the path of the ball are displayed and recorded.

13 Claims, 7 Drawing Sheets

GOLF PRACTICE APPARATUS

This is a continuation-in-part patent application to U.S. Patent Application Ser. No. 07/941,599, entitled GOLF PRACTICE APPARATUS, filed on Sep. 3, 1992, now abandoned, which in turn is a continuation-in-part patent application to U.S. Patent Application Ser. No. 07/818,199, entitled GOLF PRACTICE APPARATUS, filed on Jan. 8, 1992 now abandoned.

BACKGROUND OF THE INVENTION

In U.S. Pat. No. 4,971,325, Lipps, entitled "Golf Practice Apparatus", it was pointed out that it is important in achieving a good result in playing golf to both hit the ball correctly with the club head as well as to follow through with the club head properly, and that it is equally important that the head of the golfer be so positioned that his eye is on the ball at the right instant. In that application it was pointed out that the head should follow the club. If the ball is hit correctly the movement of the head will be such that it will be directly over and in line with the ball an instant after the club hits the ball.

Upon further development it has also been found that the head should be stationary. If the ball is hit correctly there will be no movement of the head just before and during the instant at which the ball is struck.

As far as is known now, this improvement over U.S. Pat. No. 4,971,325, Lipps, has not been considered with respect to golfer head movement in golf practice apparatus although there is considerable art in golf practice devices that may be used in conjunction with the club head.

For example, U.S. Pat. No. 4,137,566, issued Jan. 13, 1987 to Steven L. Haas, et al., utilizes light sources attached to appropriate locations on the golfer or on a golf club, the light from these sources being detected by sensors. The output from these sensors are electronically processed to provide alpha-numeric or graphic data for display. In order to use this device a golfer must swing a golf club which is impractical in many homes because of the low ceilings in most homes.

U.S. Pat. No. 4,254,956, issued Mar. 10, 1981 to Thomas L. Rusnak, discloses apparatus for photoelectrically sensing the timed position of a golf club head at selected stations along the practice swing. The characteristics of the swing and the resulting ball flight are computed electrically and displayed to the player. This device requires the use of a real golf club.

U.S. Pat. No. 4,542,906, issued Sep. 24, 1985 to Akio Takcase, et al., discloses a computer aided golf training device which detects movement of a golf ball immediately after the ball has been impacted by a club head. This requires the use of a golf club and also that a ball be struck and must, as a practical matter, be used outside.

U.S. Pat. No. 4,858,934, issued Aug. 22, 1989, to Ladick, et al., discloses a golf practice apparatus which utilizes a simulated golf club provided with a light source therein and when this is swung the movement of the simulated golf club is detected by an array of sensors which in turn produce signals which are processed in turn to produce output signals corresponding to the speed and orientation of the simulated golf club and this information is then visually displayed on a computer screen, usually in the form of a picture illustrating the flight of a golf ball, the flight varying in dependence on various characteristics of the swinging of the simulated golf club.

BRIEF SUMMARY OF THE INVENTION

The present invention utilizes a motion sensor and a radiation source on the forehead of the user which projects a radiated signal only when head motion is sensed. The signal is detected by a unit contemporaneously with the golfer's swinging either a golf club, if he is outside, or a simulated golf club provided with a beam of radiation emanating from one end thereof, if he is inside. Thus the presence or absence of motion of the golfer's head at the instant that the golf club hits the golf ball or the simulated golf club contacts the simulated golf ball is detected.

If the device is used indoors, the head motion detector is attached to a device containing a simulated golf ball and having incorporated therein sensors and lights which will indicate the angle of the club face at impact with the simulated golf ball, the position of the club at the point of impact with respect to the heel and toe of the club, the speed of the club, the tempo of the swing, the direction the club path at follow through, the distance traveled by the ball and the characteristics of the direction and curvature of the trajectory of the ball.

The device also indicates if the simulated club is too high or too low with respect to the simulated golf ball at the point of impact.

In addition, for indoor use, the club head image will be projected to address the simulated golf ball, the shape of the club head depending upon the type of club selected. Club types include woods, long irons, medium irons and short irons. Furthermore, the information generated from the movement and impact point of the simulated golf club head is compared with standard reference information to determine the distance traveled by the ball. For each club, the reference information correlates club head velocity to a resultant distance, taking into account imperfections in the golf swing.

If the device is used outside, it is used in conjunction with a detector which detects when the golf ball is hit by the club and compares this information with the position of the head of the golfer at the time of impact.

For outdoor use, an additional device is connected to the system to detect the characteristics mentioned above about an actual swing of an actual golf club, in contact with an actual golf ball. This external device is in the form of a mat with an array of embedded sensors. The sensors detect the motion of the golf club to determine the characteristics of the swing and correlation to head movement.

It is therefore an object of this invention to provide an apparatus which will detect the motion of the user's head at the time of impact of either a golf club with a golf ball for outdoor usage or a simulated golf club with a simulated golf ball in the case of indoor usage.

It is an additional object of this invention to provide such an apparatus which can be used as a golf practice device, a means of entertainment, a competitive game, or a coin or dollar operated commercial game.

It is a further object of this invention to provide such a device which will detect motion of the golfer's head at the time of impact of the golf club with the golf ball or the golf club simulator with the simulated golf ball and provide this information visually to the golfer.

It is another object of this invention to provide an indication of the motion of the golfer's head at the time of impact of a simulated golf club with a simulated golf ball and also measure the position of the club head (or simulated club head), the swing path of the club head (or simulated club head), the follow through of the club head (or simulated club head), and the tempo of the golf swing. Tempo is the time elapsed from take-away to impact.

It is still a further object of this invention to provide a simulated golf club which has the same feel and response as an actual golf club, by duplicating the mass, center of mass, rotational inertia and centripetal force of an actual club. The device is significantly shorter than an actual golf club, allowing its use in a confined area where the swing of an actual club would be impractical. This device will also project the image of a golf club head to allow the user to address a simulated golf ball.

It is an additional object of this invention to provide a connection to the device described above to interface with a printer for the purpose of logging the result of practice swings, with a modem for the purpose of transmitting and receiving the result of practice swings to a remote location through the use of telephone or other means, with a means of generating displays on a television screen such as an optical disk, or with a computer for the purpose of generating graphics or other information about the result of a practice golf swing on a computer display.

These, together with other objects and advantages of the invention will become more readily apparent to those skilled in the art when the following general statements and descriptions are read in the light of the appended drawings.

DETAILED DESCRIPTION OF THE INVENTION

Figure 1:
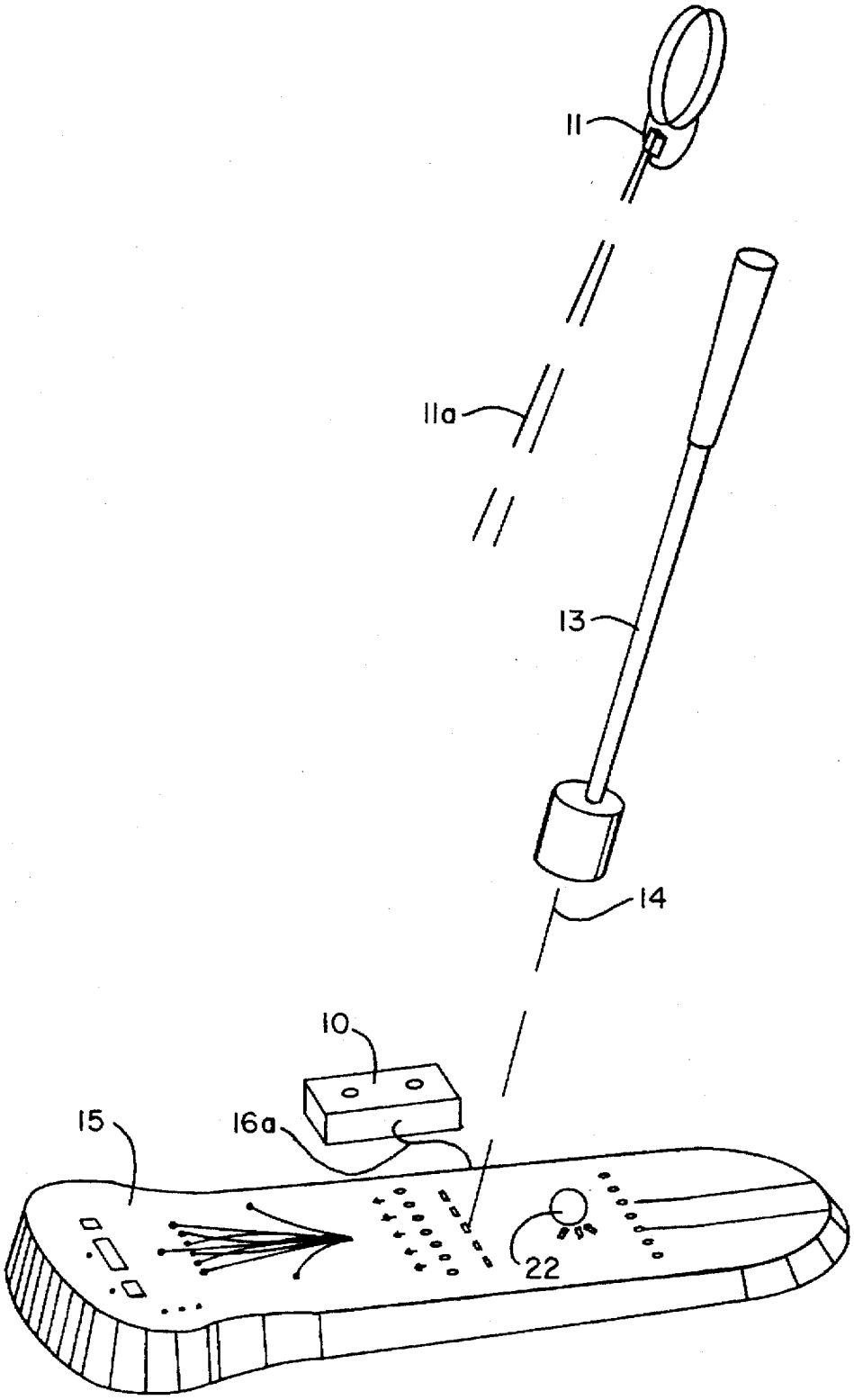
FIG. 1 is a perspective view of applicant's invention for indoor use.

Referring now more particularly to FIG. 1, the receptor for the radiation beam from the head of the user is shown generally at 10 with the source 11 positioned on a cap which could be worn by the user. The receptor may be an external item, or built into the sensing and recording device 15. 11*a* is a beam of radiation from the source 11. This radiation beam 11*a* can be visible light or a radio frequency beam or a comparable form of radiation. The simulated golf club 13 is shown emanating rays of light 14 onto the sensing and recording device 15 for home use and connected to receptor 10 by electrical lead 16*a*.

Figure 2:
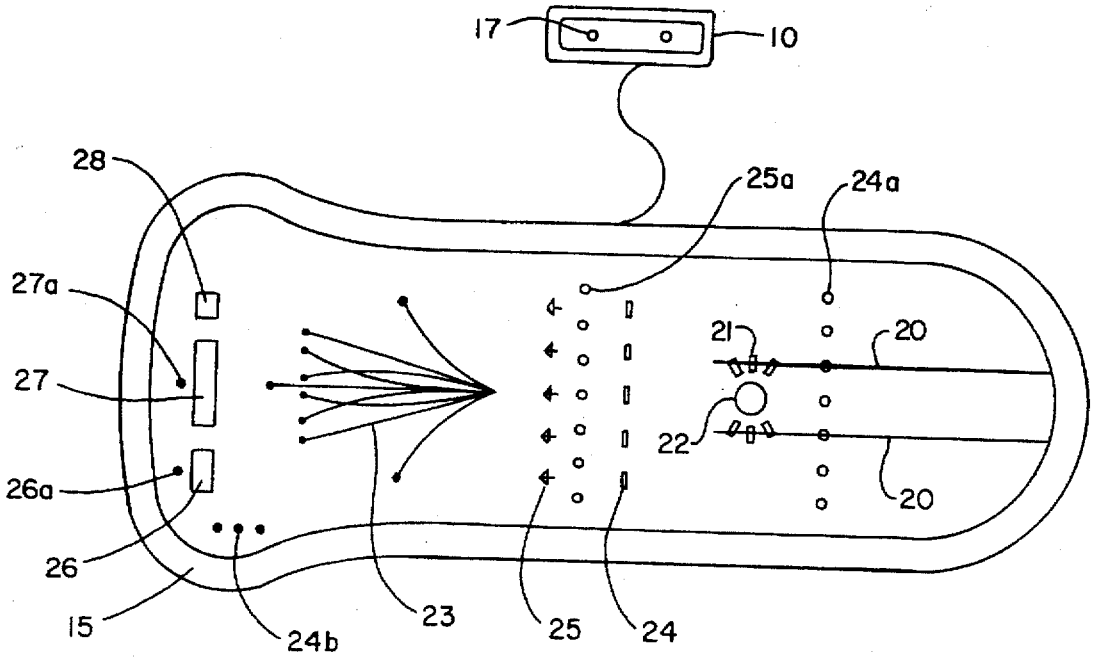
FIG. 2 is a plan view of applicant's invention for indoor use.

Referring now more particularly to FIG. 2, the receptor 10 is shown with a sensor and light display 17 for detecting the beam of radiation from the head movement detector and displaying this information. The recording and detecting device 15 is shown provided with a plurality of registers that display distance traveled by the ball 26, club head speed 27, and tempo 28. The registers also perform the functions of displaying a selected iron club, putter, or wedge 26, displaying a selected wood club 27. The sensor 26*a* is used to change the selected iron club, putter or wedge. The sensor 27*a* is used to change the selected wood club. The sensors 26*a* and 27*a* are activated by pointing the projected club head image at the desired sensor.

Light displays 23—23 indicate one of nine possible trajectories of the ball resulting from the golf swing. Displays 25—25 show the direction of the follow through as being straight, slightly left, slightly right, extremely left or extremely right. Displays 24—24 show the position of the club face at impact as being center, slightly toward the heel, slightly toward the toe, extremely toward the heel or extremely toward the toe. Displays 24*b*—24*b* indicate the altitude of the club with respect to the ball. These displays indicate if the club is too high, too low or if the club is at the proper elevation when striking the simulated ball. Displays 21—21 display the angle of the club face at impact.

Guide stripes 20—20 are provided in the vicinity of the golf ball target for the purpose of determining the correct stance for the golfer for a particular club. The projected image of the club head will fit exactly between the stripes when the user is at the appropriate distance from the target. If the user is too close, the image will be too small and if the user is too far away, the image will be too large.

Sensors 24*a*—24*a* detect the angle of the club face at impact and the position of the club with respect to the ball. These sensors also determine if the club is the proper altitude. The timing cycle to determine the tempo of the swing and the velocity of the club head begins as the light passes over the sensors.

Sensors 25*a*—25*a* detect the direction of the follow through of the swing. These sensors are also used to stop the timing cycle that indicates the club head speed.

The simulated golf club 13 contains a solid state LED light source which operates in a modulated, i.e., pulsed mode. The frequency of the pulses of light is much higher than the frequency of normal room lighting. The various photosensors in the apparatus generate a proportional signal when the light from the club 13 impinges thereon. The signal is then applied to a highpass filter which eliminates effects of ambient light and activates digital logic circuits. A microprocessor monitors the status of the logic signal from each sensor to determine the exact moment at which the light from the club reaches the individual sensors in the array.

The tempo of the golf swing is measured from the point at which the golfer begins the back swing to the point at which the impact occurs. Each swing begins by placing the club light 14 adjacent to the simulated ball 22 in the normal way in which a golfer addresses the ball. This necessarily causes the light 14 to illuminate the impact sensors 24*a*—24*a*. When the microprocessor detects this light it begins a timing cycle and ends the timing cycle when the light reaches the impact sensors 24*a*—24*a* again at the time of impact. The elapsed time is a measurement of the tempo.

The club face angle at impact is measured by the microprocessor monitoring the increment of time from which the first sensor, among the sensors 24*a*—24*a*, is active until the adjacent sensor 24*a* is active. For an ideal swing the front edge of the light is perpendicular to the desired path of the ball which makes the front edge of the light virtually parallel to the row of sensors 24*a*—24*a*. As a result, the time interval from the first active sensor to the adjacent sensor is measured in microseconds. The larger the time interval the larger the club face angle. The microprocessor also monitors the time interval from which the impact sensors 24*a*—24*a* are activated until the follow-through sensors 25*a*—25*a* are activated. This measured time interval allows the club speed to be calculated because the distance between the two rows of sensors is known. Impact position on the face of the club is determined by the total number of sensors active at the point of impact. If four or more sensors 24a—24a are active at the point of impact it is determined that the light is too large as it passes through the ball, therefore, it is assumed that the golf swing generates a club head that is too far off the ground. Conversely, if only one or two sensors are active the light must be too small indicating that the club is too close to the ball. This method of measuring impact position is dependent upon a selection of club image sizes for different clubs. The club path is determined by a comparison of the sensors 24a—24a active at impact and the sensors 25a—25a active at follow-through. If the respective sensors from the two rows are in line, the swing is determined to be straight. If the active sensors have different relative positions, the swing is determined either to be toward the inside or toward the outside of the ball path.

The ball path is determined by a combination of the club face angle at impact and the path of the club. The path of the club determines the direction in which the ball takes off from the tee and the relative angle of the club face determines if the ball will fly straight or curve to the right or the left when it is in the air. Nine flight paths are possible as a result of three possible club face angles and three possible club paths.

The ball flight distance is calculated by multiplying club speed by a distance factor for each type of club. Percentages are subtracted from distance for inaccuracies.

Figure 3:
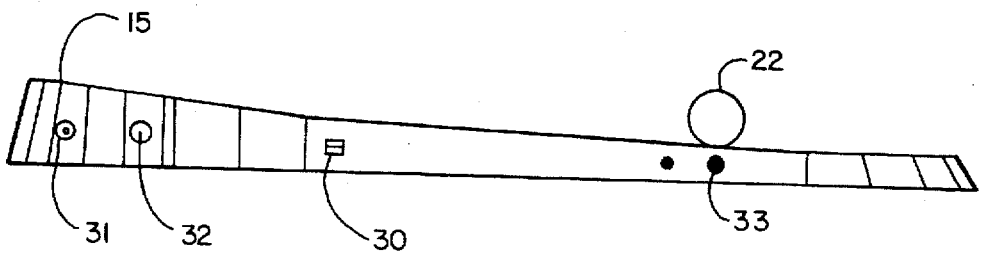
FIG. 3 is a side elevation view of applicant's invention.

Referring now more specifically to FIG. 3, the simulated golf ball 22 is shown. The unit may be powered by AC or DC power sources. Batteries for DC use are inserted at 31. The on-off switch is shown at 30 and an audio response speaker, which simulates the sound of the club striking a ball is shown at 32. Connections for peripheral devices are shown at 33—33.

Figures 4, 4A:
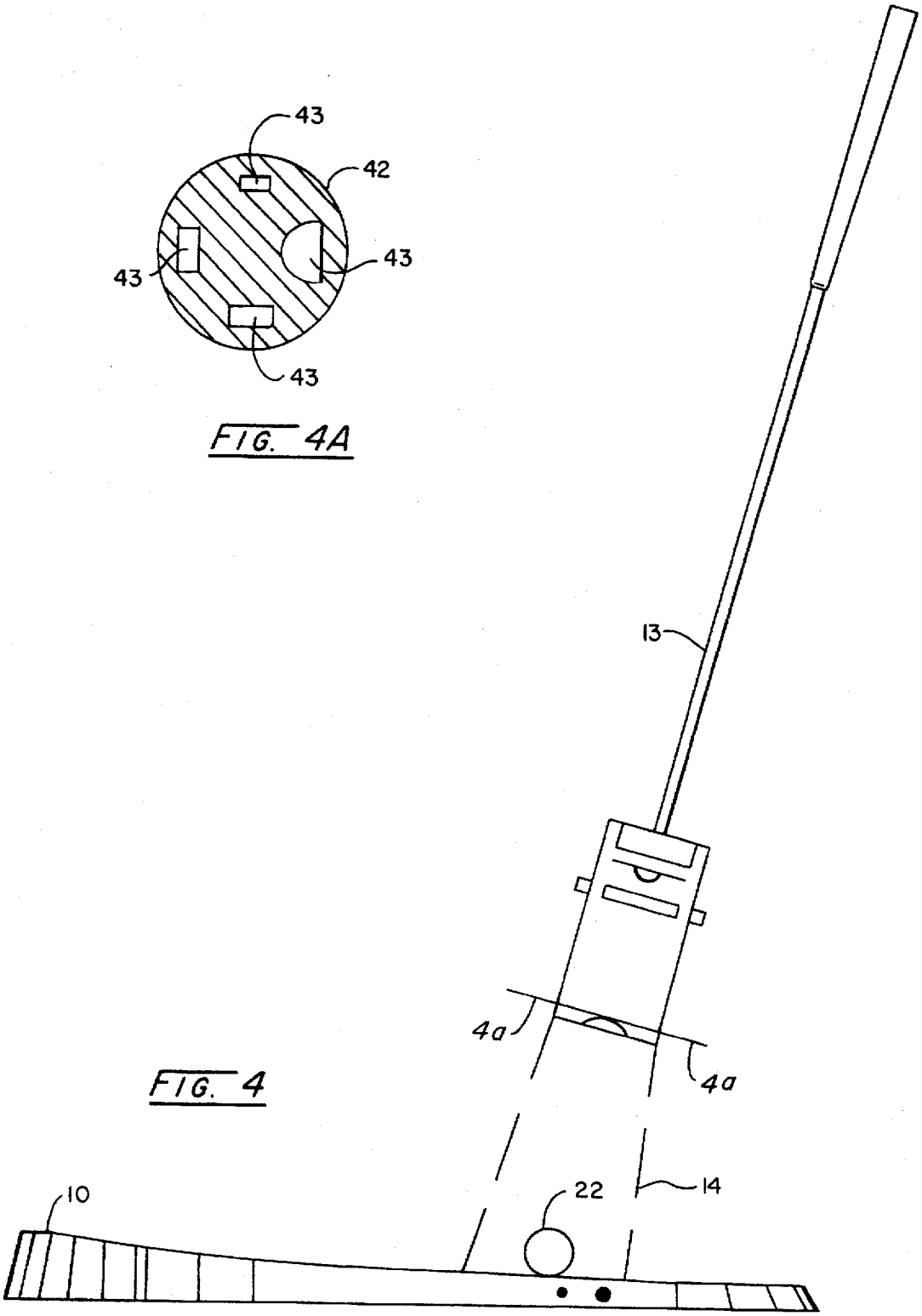
FIG. 4 is a side elevation view of the simulated golf club showing the image presented by it for the benefit of the user.
FIG. 4*a* is a section 4*a*—4*a* through the head of the simulated golf clubs.

Referring now more specifically to FIGS. 4 and 4a, the simulated golf club 13 is shown. The club projects an image 41 for the benefit of the user to position the club to address the golf ball. The club 13 provides a means of selection to change the projected image of the club 13 to represent several different club types, including woods, long irons, medium irons, short irons, putter and wedge. Within the club, a disc 42 is provided as shown in FIG. 4a, with 4 distinct cut-out shapes 43—43. Each cut-out masks the light source to generate a distinct size and shape for the projected image. The disc can be rotated in increments of 90 degrees to select the appropriate mask. The image size varies for different types of clubs to allow the user to adjust his stance to simulate that of playing with actual clubs.

Figure 5:
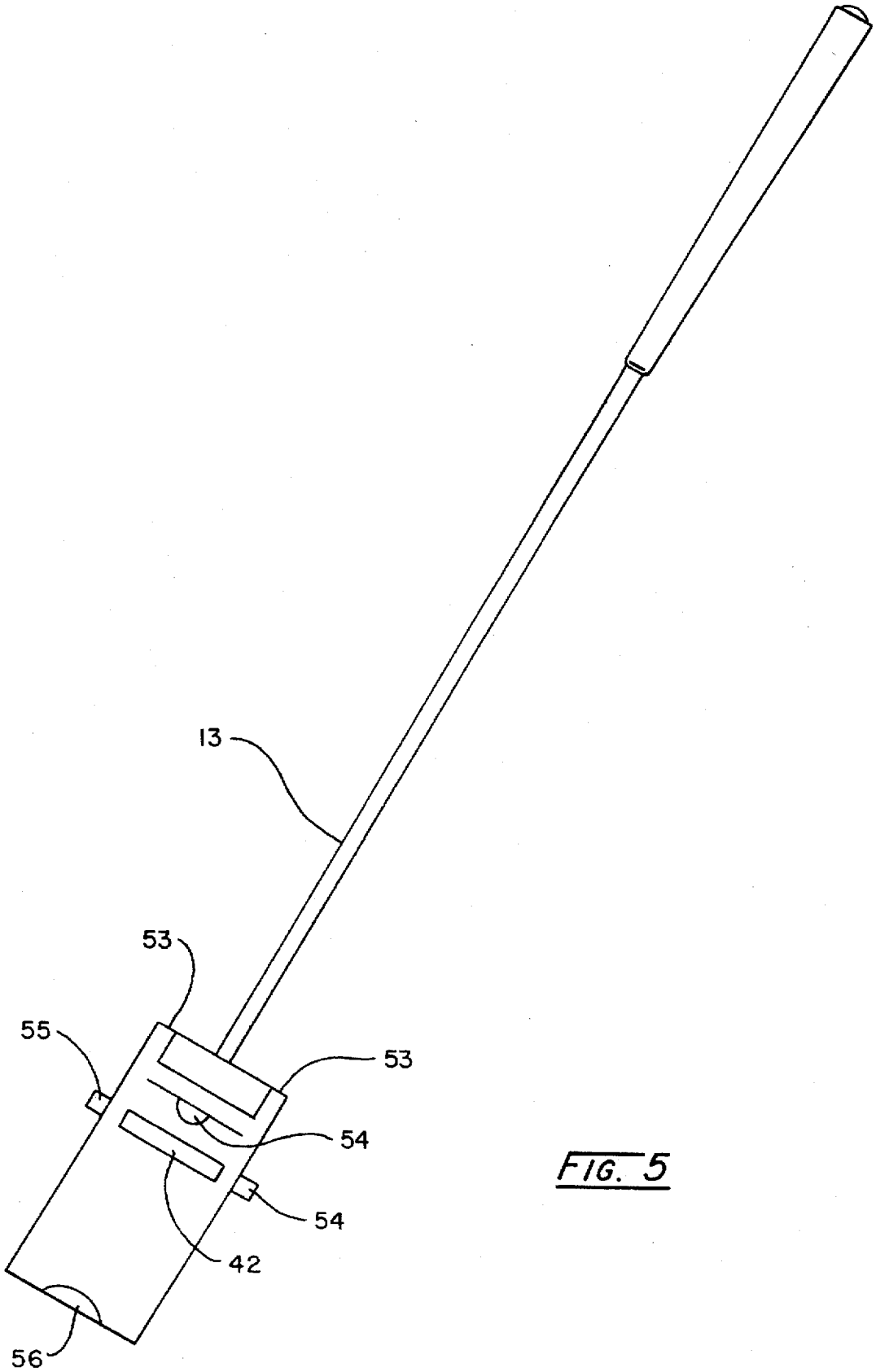
FIG. 5 is a side elevation view of the simulated golf club showing the details of its construction.

Referring now more particularly to FIG. 5, the simulated golf club is shown at 13 containing an internal DC power source 51, a conventional switch means 54 for turning said power source 51 on and off a modulated solid state light source 52, and a weight 53 to provide a collective weight of the golf club to stimulate the feel and response of a conventional club. The formulae for mass, center of mass, rotational inertia and centripetal force are applied to approximate the static and dynamic physical properties of an actual golf club. A selection mechanism 42 is used to select the image of the club head to resemble a variety of actual golf club head shapes. A lens 56 is used to project the light image and an indicator 55 is active when battery power is low.

Figure 6:
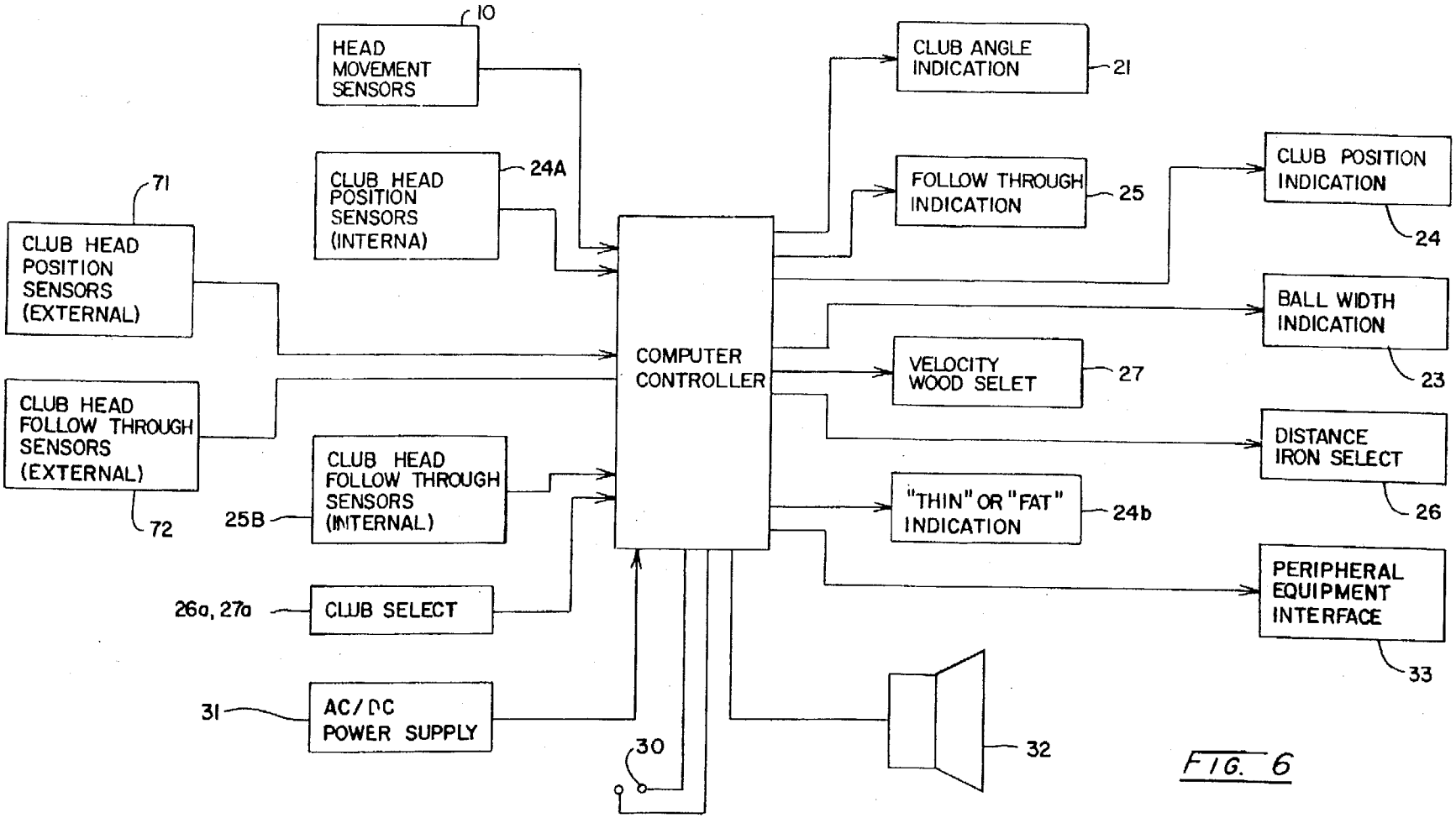
FIG. 6 is a schematic wiring diagram of the base unit shown in FIG. 2.
Figure 7:
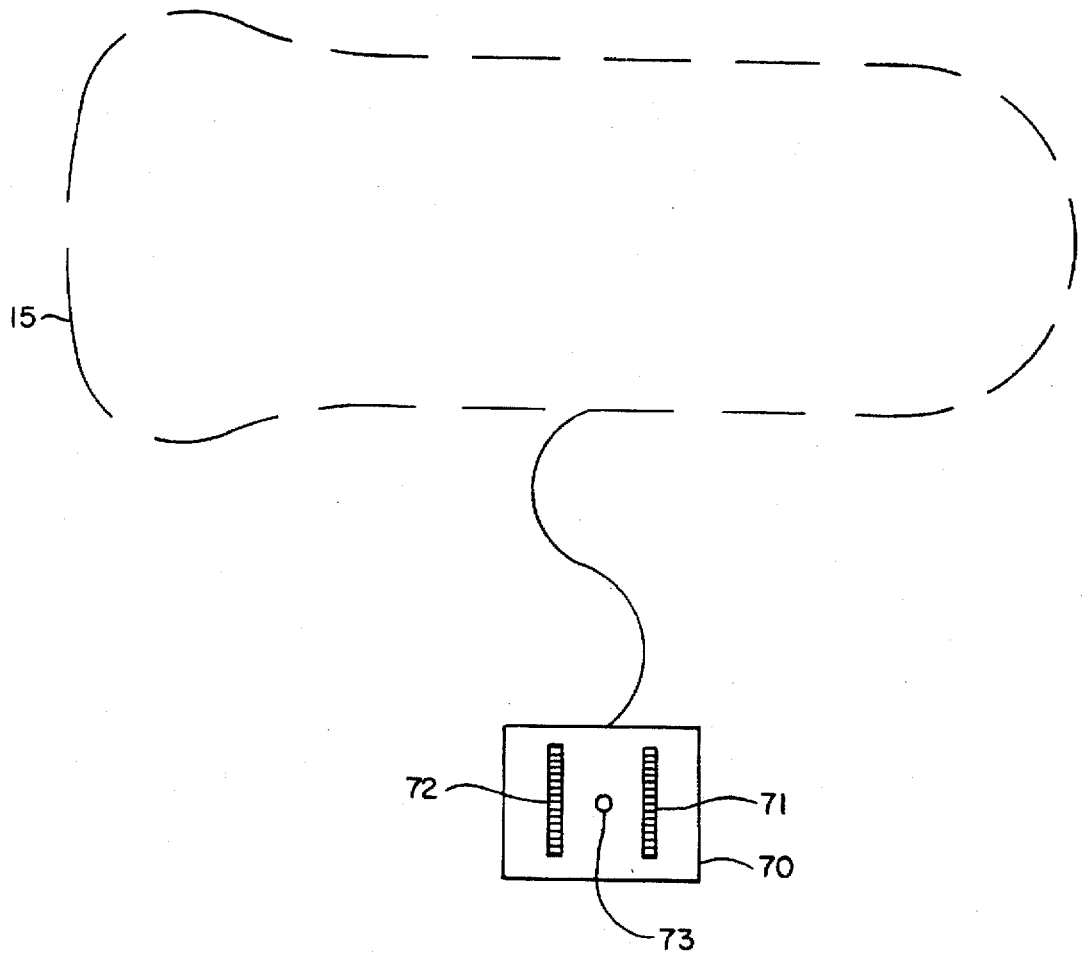
FIG. 7 is a plan view of this invention shown for outdoor use.

FIG. 6 is a schematic wiring diagram of the devices shown in FIG. 2 and FIG. 7 with the various registers shown generally at 26, 27, 28 and 29 and the club head position indicators 24—24. The follow through path detectors and light displays are shown at 25—25. External club position sensors 71—71 and follow through sensors 72—72 from the outdoor device are shown. Nine displays for the resultant ball trajectory are shown at 23. All of these items are connected to a computer controller provided with an AC/DC power supply. Outputs from the computer controller also include an annunciator 32 to simulate the sound of impact of the club head on the ball and interfaces to peripheral equipment 33.

Referring now more specifically to FIG. 7, the outdoor attachment 70 is shown. This device is used while hitting a conventional golf ball with a conventional golf club. This device contains sensors 71 that will detect the movement of an actual golf club at the point of impact and sensors 72 which are activated by the motion of the follow through of the golf club swing, and send impulses to the receptor 15 allowing information about the golf swing to be displayed in a similar manner as described above.

Figure 8:
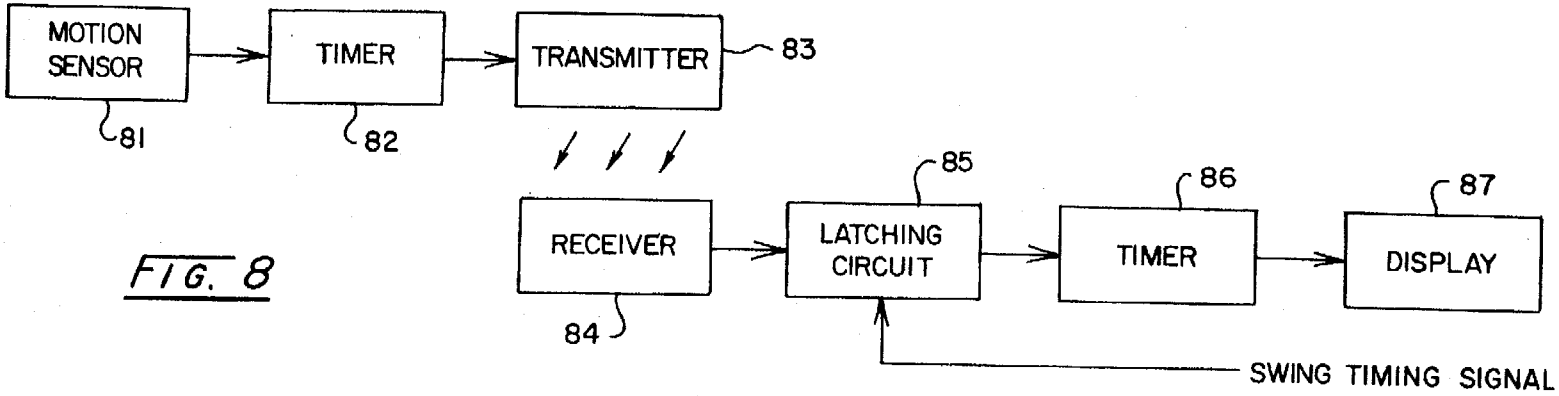
FIG. 8 is a schematic wiring diagram for the head movement transmitter and receiver shown in FIG. 1.

Referring now more particularly to FIG. 8, there is shown a detail of the schematic wiring diagram of the device shown in FIG. 1. The transmitting device consists of a motion sensor 81, a timer 82, and a transmitter 83, which the golfer wears on a visor cap. The transmitting device is powered by a battery. The receiving device consists of a means of receiving the signal from the transmitter 84 and a latch 85, which stores the level of the received signal at the instant of the golf swing, thus synchronizing the measurement of the golfer's head movement with the swing of the club. A timer 86 is included to operate the visual indication 87 on a display device.

When the motion sensor 81 is activated, it triggers a timing circuit 82 which in turn enables the transmitter 83 for an interval of approximately 1 second. The receiver 84 detects the signal, and provides an input to the latching circuit 85. The latching circuit passes the state of the input signal to the output at the instant that the golf swing occurs. If the receiver 84 is active at the time of the swing, the latching circuit enables a timer 86 to generate a visual indication on the display 87. If the receiver does not detect a transmitted signal at the time of the swing, the timer 86 and display 87 will remain inactive.

Figure 9:
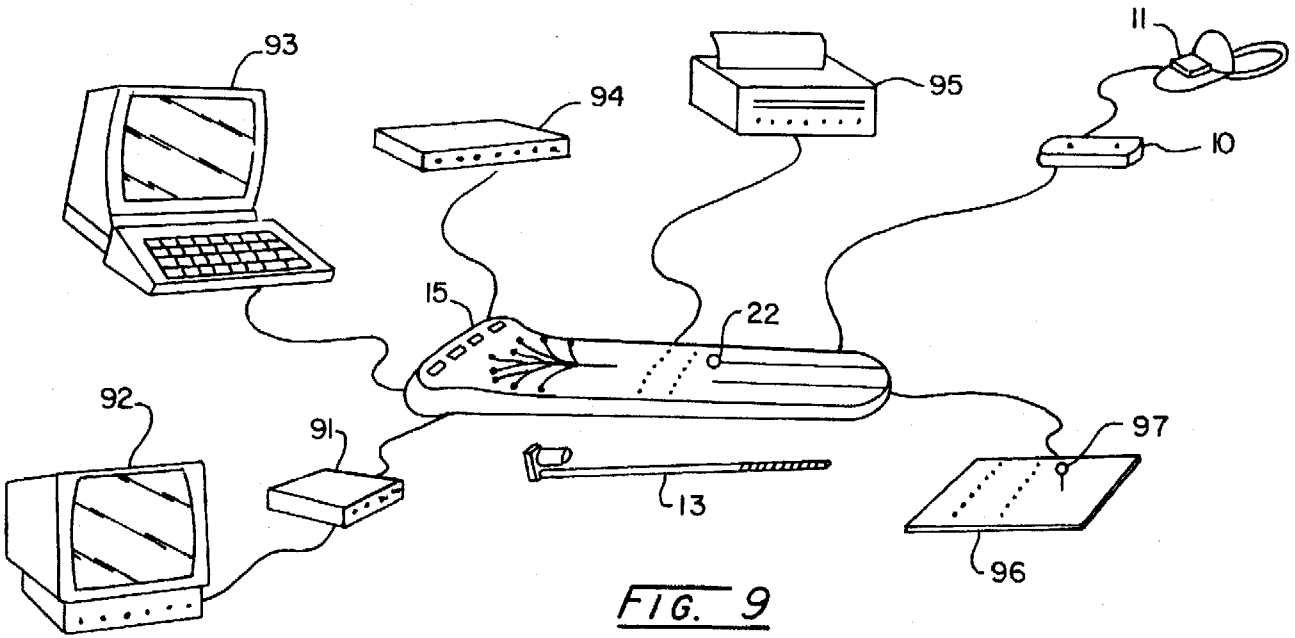
FIG. 9 is a perspective view of applicant's invention with peripheral equipment.

Referring now more particularly to FIG. 9, the complete golf practice system is shown with peripheral equipment. Specifically, these items include: a video disk adapter 91 and a television monitor 92 for video displays; a computer 93 for video, animated graphics or other output; a modem 94 for transmitting and receiving golf practice or golf game results to and from remote locations; and a printer 95 for generating a printed record of golf practice or other output; and an outdoor mat 96 and ball 97. The interface between the golf practice apparatus and these peripheral devices is in RS-232 serial data connection operated 9600 baud rate in the preferred embodiment of the invention. This type of data connection is manufactured by a number of companies, among which is IBM, Logitech and Hayes. Other serial data communication interfaces work equally well, such as RS-485 or RS-422. Parallel data interfaces also can be used.

In the preferred embodiment of this invention, the data protocol is comprised of a string of ASCII transmitted from the golf apparatus. The ASCII characters in the string enumerate the club's speed and distance as numeric values and appropriate numeric codes to specify ball trajectory, golf club face orientation, club path, etc. Values in the string are delineated by Carriage Return and Line Feed Characters.

Each string begins with an upper case alphabet character and ends with the exclamation character (exclamation point). There are other protocols that are equally well suited to this application.

While this invention has been described in its preferred embodiment, it is to be appreciated that variations therefrom may be made without departing from the true scope and spirit of the invention.

What is claimed is:

1. An apparatus for the practicing of golf swings comprising:

means to be worn on the head of the user for projecting a beam of radiation from the forehead of the user, means for activating said beam of radiation only by head movement of the user as the user swings a golf club, a first detector means for detecting said beam of radiation.

2. The apparatus of claim 1 wherein said beam of radiation is a light beam.

3. The apparatus of claim 1 wherein said beam of radiation is a radio frequency beam.

4. The apparatus of claim 1 which includes a visual display which is lit when said beam of radiation is detected by said detector means at the time of the swing of a club or simulated club. as well as the speed and direction of the follow through of said golf club head and the resultant path of the ball.

5. The apparatus of claim 1 comprising in addition thereto:

an elongate member to be swung by a user in simulation of the swinging of a golf club, said elongate member comprising a simulated golf club and being shorter than a conventional golf club, but having approximately the same feel and response, a source of modulated light contained within said elongate member, a beam of modulated light extending from one end of said elongate member in an axial direction, said modulated light beam displaying a projected image of the outline of a simulated golf club head, a means for changing the size and shape of the said projected image from said elongate member so as to allow the user to adjust his stance to simulate the use of a variety of actual golf clubs.

a simulated golf ball, a plurality of sensor means adjacent said simulated golf ball and responsive to said modulated light beam and disposed in a predetermined array for producing sensor signals in response to the passage of said conventional light beam over said array during the swinging of said elongate member, said sensor signals lighting lights adjacent thereto so as to provide a visual representation of the position and skew of said simulated golf club head upon impact with said simulated golf ball, as well as the speed and direction of the follow through of said golf club head and the resultant path of the ball.

6. The apparatus of claim 5 wherein distance traveled in the resultant path of the ball is determined by comparing standard reference information.

7. The apparatus of claim 5 wherein means are included visually to display whether or not said first detector means is actuated immediately before said simulated golf club head engages said simulated golf ball.

8. The apparatus of claim 7 which includes a visual display which is lit when said beam of radiation is detected by said first detector means at the time of the swing of the club or simulated club.

9. The apparatus of claim 5 wherein said beam of radiation from the forehead of said user is selected from the group consisting of a light beam and radio frequency.

10. The apparatus of claim 5 comprising in addition thereto:

interface and connection for a modem, interface and connection for a printer, interface and connection for a computer system, interface and connection for optical disk-based television graphics, interface and connection for computer-based television graphics.

11. An apparatus for the practicing of golf swings comprising:

an elongate member to be swung by a user in simulation of the swinging of a golf club, said elongate member comprising a simulated golf club and being shorter than a conventional golf club, but having approximately the same feel and response, a source of modulated light contained within said elongate member, said source of modulated light being continuously activated during use of said elongate member, a beam of modulated light extending from one end of said elongate member in an axial direction, said modulated light beam displaying the outline of a simulated golf club head, means for changing the size and shape of said projected image from said elongate member so as to allow the user to adjust his stance to simulate the use of a variety of actual golf clubs, a base provided with guide stripes thereon for indicating placement of said projected image therebetween when said user is at the proper distance therefrom depending upon the type of selected simulated club.

12. The apparatus of claim 11 wherein indicia are provided with which said user may compare the size and shape of said projected image so as to adjust his stance to simulate the proper stance for the particular projected image chosen.

13. The apparatus of claim 11 comprising:

a simulated golf ball, said base having a plurality of sensor means adjacent said simulated golf ball in response to said modulated light beam and disposed in a predetermined array for producing sensor signals in response to the passage of said modulated light beam over said array during the swinging of said elongate member, said sensor signals fighting lights adjacent thereto so as to provide a visual representation of the position and skew of said simulated golf club upon impact with said simulated golf ball as well as the speed and direction of the follow-through of said golf dub head and the resultant path of the ball.

* * * * *